US011066777B2

(12) United States Patent
Xu et al.

(10) Patent No.: US 11,066,777 B2
(45) Date of Patent: Jul. 20, 2021

(54) DRAINAGE AND DEWATERING CONTROL METHOD FOR SELF-CLEANING WASHING MACHINE

(71) Applicant: QINGDAO HAIER WASHING MACHINE CO., LTD., Shandong (CN)

(72) Inventors: Sheng Xu, Shandong (CN); Zunan Liu, Shandong (CN); Yanfen Lv, Shandong (CN)

(73) Assignees: CHONGQING HAIER WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 459 days.

(21) Appl. No.: 15/775,486

(22) PCT Filed: Oct. 27, 2016

(86) PCT No.: PCT/CN2016/103557
§ 371 (c)(1),
(2) Date: May 11, 2018

(87) PCT Pub. No.: WO2017/080364
PCT Pub. Date: May 18, 2017

(65) Prior Publication Data

US 2018/0355544 A1 Dec. 13, 2018

(30) Foreign Application Priority Data

Nov. 11, 2015 (CN) ..... 201510766801.3

(51) Int. Cl.
*D06F 39/08* (2006.01)
*D06F 23/04* (2006.01)
(Continued)

(52) U.S. Cl.
CPC ..... *D06F 39/083* (2013.01); *B08B 9/0817* (2013.01); *B08B 9/0821* (2013.01);
(Continued)

(58) Field of Classification Search
None
See application file for complete search history.

(56) References Cited

U.S. PATENT DOCUMENTS

2015/0096333 A1 4/2015 Shu et al.

FOREIGN PATENT DOCUMENTS

CN 101413198 A 4/2009
CN 101643994 A 2/2010
(Continued)

OTHER PUBLICATIONS

English Machine Translation of CN-102234902-A; 2011.*
(Continued)

*Primary Examiner* — Mikhail Kornakov
*Assistant Examiner* — Pradhuman Parihar
(74) *Attorney, Agent, or Firm* — Buchanan Ingersoll & Rooney PC

(57) ABSTRACT

Cleaning particles are arranged in a space between the inner tub and the outer tub of a washing machine. A drainage and dewatering control method comprises: opening a drainage valve; determining the amount of the cleaning particles per each unit volume of water in the space; and controlling the rotating speed of the inner tub. Drainage and dewatering processes are divided into at least two control stages according to the amount of the cleaning particles per each unit volume of water in the space, different rotating ways of the inner tub are set in respective stages, and the rotating speed of the inner tub is higher in the stage that the amount of the cleaning particles per unit volume of water is larger. A
(Continued)

control stage is selected according to the detected amount of the cleaning particles per unit volume of water in the space.

12 Claims, 4 Drawing Sheets

(51) Int. Cl.

| | |
|---|---|
| ***D06F 35/00*** | (2006.01) |
| ***D06F 33/00*** | (2020.01) |
| ***B08B 9/08*** | (2006.01) |
| ***D06F 37/12*** | (2006.01) |
| ***D06F 39/06*** | (2006.01) |

(52) U.S. Cl.
CPC ..... *D06F 23/04* (2013.01); *D06F 33/00* (2013.01); *D06F 35/008* (2013.01); *D06F 37/12* (2013.01); *D06F 39/06* (2013.01)

(56) References Cited

FOREIGN PATENT DOCUMENTS

| | | | |
|---|---|---|---|
| CN | 102234902 | A | * 11/2011 |
| CN | 102234902 | A | 11/2011 |
| CN | 102357494 | A | 2/2012 |
| CN | 102733145 | A | 10/2012 |
| CN | 102154804 | B | 8/2016 |
| EP | 2860303 | A1 | 4/2015 |
| JP | 2015-523878 | A | 8/2015 |
| JP | 2015-156881 | A | 9/2015 |

OTHER PUBLICATIONS

International Search Report (PCT/ISA/210) dated Jan. 20, 2017, by the Chinese Patent Office as the International Searching Authority for International Application No. PCT/CN2016/103557.

Written Opinion (PCT/ISA/237) dated Jan. 20, 2017, by the Chinese Patent Office as the International Searching Authority for International Application No. PCT/CN2016/103557.

Extended European Search Report dated Oct. 8, 2018, issued by the European Patent Office in corresponding European Application No. 16863541.5. (7 pages).

Office Action (Notification of Reasons for Refusal) dated Dec. 3, 2019, by the Japanese Patent Office in corresponding Japanese Patent Application No. 2018-523762 and English translation of the Office Action. (4 pages).

* cited by examiner

DRAINAGE AND DEWATERING CONTROL METHOD FOR SELF-CLEANING WASHING MACHINE

TECHNICAL FIELD

The present disclosure relates to the field of washing machines, particularly relates to a control method of a washing machine and more particularly relates to a drainage and dewatering control method for a self-cleaning washing machine.

BACKGROUND

For the existing washing machine, an pulsator at the bottom of an inner tub is driven by a motor to alternately rotate clockwise and anticlockwise, and the clothes are driven to overturn and rotate, so that mutual friction is generated between the clothes and the clothes, the clothes and the pulsator as well as the clothes and the tub, and furthermore, the aim of cleaning the clothes is achieved.

When the clothes are washed, water contains various solid particles such as incrustation scales formed by calcium ions and calcium carbonate in the water, free substances in a liquid detergent, fiber tows dropped from the clothes by washing, oil stain proteins and various organic residues retained on the washed clothes by human beings as well as bacteria and other substances brought by the washed clothes, and the various solid particles form a suspension. Diffusion is unconditional and absolute, and therefore, the smaller the particles are, the more serious the diffusion is. The particles such as viruses or proteins which are smaller than a few micrometers are very easily diffused into an interlayer between tubs of the washing machine and are attached to the outer wall of an inner tub and the inner wall of an outer tub of the washing machine after being accumulated over a long period to form generally said dirt. The dirt can generate secondary pollution to the clothes so as to threaten the health of users.

Based on the condition, a special program for cleaning the tubs, namely a tub cleaning program, is set on many fully-automatic washing machines. A Chinese patent CN200810061541.X disclosed two control methods for the tub cleaning program of the fully-automatic washing machines, and tub cleaning principles in the two methods are same in that the dirt is flushed by virtue of a centrifugal force. The first method comprises: after finishing the last-time rinsing, opening a drainage valve, and carrying out drainage until a water level controller of a signal detecting circuit monitors that the water level inside the outer tub reaches a first water level; controlling the drainage valve to be closed by a computer program controller, and stopping carrying out drainage; controlling the motor to be electrified by the computer program controller, and rotating the inner tub until a time controller of the computer program controller detects to reach a first set time; controlling the motor to be non-electrified by the computer program controller, and freely rotating the inner tub until the time controller of the computer program controller detects to reach a second set time; controlling the drainage valve to be opened by the computer program controller, and carrying out drainage until the water level controller of the signal detecting circuit monitors that the water level inside the outer tub reaches a second set water level; and entering a normal dewatering program. The second method comprises: after finishing the last-time rinsing, opening a drainage valve, and carrying out drainage until a water level controller of a signal detecting circuit monitors that the water level inside the outer tub reaches a first water level; controlling the motor to be electrified by a computer program controller, and rotating the inner tub until the water level controller of the signal detecting circuit monitors that the water level inside the outer tub reaches a second set water level; controlling the motor to be non-electrified by the computer program controller, and freely rotating the inner tub; and entering a normal dewatering program.

The first method in the solution has the following defects:

1. the method is only used for cleaning the tubs when a user selects the tub cleaning program and carries out the last-time drainage, so that the cleaning strength is relatively poor, and a dirt forming source, namely dirt accumulated by washing clothes every time, cannot be eliminated;

2. during drainage, the tubs are static in a process that the water level is reduced from the first set water level to the second set water level after the drainage valve is opened, so that dirt in sewage can still be adhered to the section of walls of the tubs and cannot be thoroughly cleaned; and 3. the inner tub is only utilized to drive a water flow to generate an impact force to clean the walls of the tubs in the method, so that it is relatively difficult to guarantee a tub cleaning effect.

The second defect in the first method is overcome in the second method, however, the first and third defects still exist.

Before, the applicant researched and developed a washing machine provided with cleaning particles between an inner tub and an outer tub, and the cleaning particles are driven by the flowing of water in a clothes washing process to generate friction with the walls of the inner tub and the outer tub of the washing machine, so that the cleaning between the inner tub and the outer tub of the washing machine is realized. The cleaning problem for the dirt on the walls of the tubs is solved by the solution, found by research, the dirt retained from top to bottom on the walls of the inner tub and the outer tub of an ordinary washing machine is more and more, the pollution levels of the tub walls at the upper part are relatively low, and the pollution levels of the tub walls at the lower part are relatively high, and particularly, the pollution levels of the bottom walls of the tubs are the highest. While the time that the cleaning particles between the inner tub and the outer tubs stay between the peripheral walls of the inner tub and the outer tub, particularly in the middle and upper regions, within the range of moving along with the water flow in a washing process is relatively long, but the time that the cleaning particles between the inner tub and the outer tubs stay between the bottoms of the inner tub and the outer tubs and at the lower part between the peripheral walls of the inner tub and the outer tub is relatively short, and therefore, the cleanliness of the bottom walls and the lower parts of the peripheral walls of the inner tub and the outer tub is relatively low.

The applicant disclosed a collection control method for cleaning particles of a washing machine with a self-cleaning function and the washing machine in a Chinese patent CN201210188593.X, the cleaning particles for cleaning walls of an inner tub and an outer tub along with the movement of a water flow are arranged between the inner tub and the outer tub of the washing machine, the inner tub is controlled to operate with different actions in a drainage process and/or a spin-drying process, and the cleaning particles are flushed into a drainage outlet and are collected by the drainage valve. In the drainage process, the inner tub rotates to drive the water flow to rotate, so that the walls of the inner tub and the outer tub are cleaned by the cleaning particles, meanwhile, the cleaning particles clamped between the inner tub and the outer tub drop down and flow into the drainage outlet together with the water flow along with the decline of the water level so as to be collected by the drainage valve. At the spin-drying stage, the inner tub is controlled to execute at least one action of rotation braking, so that the cleaning particles clamped between the inner tub and the outer tub drop down, are flushed into the drainage outlet by water spun out of clothes and are collected by the drainage valve. However, during drainage in the solution, the inner tub is controlled to rotate at a low speed, which cannot drive the cleaning particles to generate collision with the walls of the tubs, but is merely intended to reduce the cleaning particles retained between the inner tub and the outer tub, so that the cleaning particles can be completely collected, collision noise caused during dewatering can be reduced, and the cleaning for the bottom walls and the lower parts of the peripheral walls of the inner tub and the outer tub cannot be enhanced.

For this purpose, a drainage and dewatering control method for a self-cleaning washing machine is provided.

SUMMARY

Technical problems to be solved by the present disclosure are to overcome defects in the prior art and provide a drainage and dewatering control method for a self-cleaning washing machine, which is capable of completely removing dirt on walls of tubs of the washing machine, keeping a washing environment clean, avoiding secondary pollution and increasing the cleaning rate of clothes.

In order to solve the technical problems, the basic conception of the technical solution adopted by the present disclosure is:

a drainage and dewatering control method for a self-cleaning washing machine, cleaning particles for cleaning the outer wall of an inner tub and the inner wall of an outer tub along with the movement of a water flow being arranged in a space located between the inner tub and the outer tub of the washing machine, comprises:

receiving a drainage instruction, and opening a drainage valve;

determining the amount of the cleaning particles per each unit volume of water in the space; and controlling the rotating speed of the inner tub, and regulating the frequency of friction and collision between the cleaning particles and the inner and outer tub walls.

Further, the washing machine divides drainage and dewatering processes into at least two control stages according to the amount of the cleaning particles per each unit volume of water in the space, different rotating ways of the inner tub are set in respective stages, and the rotating speed of the inner tub is higher in the stage that the amount of the cleaning particles per each unit volume of water is larger.

Further, the washing machine selects the corresponding control stage in the drainage and dewatering processes according to the detected amount of the cleaning particles per each unit volume of water in the space.

Further, a method for controlling the rotation of the inner tub in one control stage comprises: closing the drainage valve, controlling the inner tub to rotate at a set rotating speed for a set time, then opening the drainage valve, controlling the inner tub to rotate at another set rotating speed and determining the amount of the cleaning particles per each unit volume of water, and entering the next control stage when the amount of the cleaning particles per each unit volume of water conforms to the amount corresponding to the next stage.

Further, whether the current steps of drainage and dewatering are steps of drainage and dewatering after washing or not is further judged when the amount of the cleaning particles per each unit volume of water in the space is determined to meet a set condition, and the different rotating ways of the inner tub are regulated according to the condition whether the state is drainage and dewatering after washing or not.

Further, the current drainage and dewatering are determined to be the drainage and dewatering after washing, the drainage valve is closed, the inner tub is controlled to rotate at the set rotating speed for the set time, the drainage valve is opened, and the inner tub is controlled to rotate at the other set rotating speed; and the current drainage and dewatering are determined not to be the drainage and dewatering after washing, the drainage valve is closed, the inner tub is controlled to respectively rotate with at least two different rotating speeds for a set time, the drainage valve is opened, and the inner tub is controlled to rotate at the other set rotating speed.

Further, the rotating speed of the inner tub when the drainage valve is closed is controlled to be higher than the rotating speed of the inner tub when the drainage valve is opened.

Further, a drainage and dewatering control method for a self-cleaning washing machine, provided by the present disclosure, comprises:

(1) carrying out drainage, opening the drainage valve, and entering the next step;

(2) judging whether the amount K of the cleaning particles per each unit volume of water in the space is larger than or equal to K5 or not, if yes, entering step (6), and if not, entering the next step;

(3) judging whether K is larger than or equal to K4 or not, if yes, entering the next step, and if not, carrying out drainage until K is larger than or equal to K4, and entering the next step;

(4) closing the drainage valve, controlling the inner tub to rotate at a rotating speed V1 for a time T1, and entering the next step;

(5) opening the drainage valve, controlling the inner tub to rotate at a rotating speed V4 until K is larger than or equal to K5, and entering the next step; and (6) performing a dewatering program until the dewatering is ended.

The rotating speeds of the inner tub are controlled as above, i.e., V1>V4, the cleaning particles violently move along with the water flow to clean the walls of the tubs within the time period that the inner tub rotates at the rotating speed V1, even if the inner tub stops rotating at the rotating speed V1 and rotates at the rotating speed V4, although the water flow rotates relatively slowly, the cleaning particles can still generate friction with the walls of the tubs and can clean the walls of the tubs due to the action of inertia, while the inner tub rotates at the lower speed V4, so that the concentration of the cleaning particles can be conveniently detected.

Further, an alternative solution of the solution is that a drainage and dewatering control method for a self-cleaning washing machine, provided by the present disclosure, comprises:

(1) carrying out drainage, opening the drainage valve, and entering the next step;

(2) judging whether the amount K of the cleaning particles per each unit volume of water in the space is larger than or equal to K5 or not, if yes, entering step (9), and if not, entering the next step;

(3) judging whether K is larger than or equal to K4 or not, if yes, entering the next step, and if not, entering step (6);

(4) closing the drainage valve, controlling the inner tub to rotate at the rotating speed V1 for the time T1, and entering the next step;

(5) opening the drainage valve, controlling the inner tub to rotate at the rotating speed V4 until K is larger than or equal to K5, and entering step (9);

(6) judging whether K is larger than or equal to K3 or not, if yes, entering the next step, and if not, carrying out drainage until K is larger than or equal to K3, and entering the next step;

(7) judging whether the drainage and dewatering are the drainage and dewatering after washing or not, if yes, closing the drainage valve, controlling the inner tub to rotate at a rotating speed V2 for a time T3, and entering the next step, and if not, closing the drainage valve, and controlling the inner tub to respectively rotate at the rotating speeds V2 and V1 for a time T2, and entering the next step;

(8) opening the drainage valve, controlling the inner tub to rotate at the rotating speed V4 until K is larger than or equal to K4, and entering the step (4); and (9) performing the dewatering program until the dewatering is ended.

The rotating speeds of the inner tub are controlled as above, i.e., V1>V2>V4. The inner tub rotates at the relatively low speed V2 if the drainage and dewatering are the drainage and dewatering after washing, so that foam is prevented from overflowing, and the safety is improved; and the inner tub rotates at two different rotating speeds if the drainage and dewatering are not the drainage and dewatering after washing, so that not only can the efficiency of cleaning the walls of the tubs be increased, but also the phenomenon of foam overflowing possibly caused by drainage and dewatering after first-time rinsing.

Further, an alternative solution of the solution is that a drainage and dewatering control method for a self-cleaning washing machine, provided by the present disclosure, comprises:

(1) carrying out drainage, opening the drainage valve, and entering the next step;

(2) judging whether the amount K of the cleaning particles per each unit volume of water in the space is larger than or equal to K5 or not, if yes, entering step (11), and if not, entering the next step;

(3) judging whether K is larger than or equal to K4 or not, if yes, entering the next step, and if not, entering step (6);

(4) closing the drainage valve, controlling the inner tub to rotate at the rotating speed V1 for the time T1, and entering the next step;

(5) opening the drainage valve, controlling the inner tub to rotate at the rotating speed V4 until K is larger than or equal to K5, and entering step (11);

(6) judging whether K is larger than or equal to K3 or not, if yes, entering the next step, and if not, entering step (9);

(7) judging whether the drainage and dewatering are the drainage and dewatering after washing or not, if yes, closing the drainage valve, controlling the inner tub to rotate at the rotating speed V2 for the time T3, and entering the next step, and if not, closing the drainage valve, and controlling the inner tub to respectively rotate at the rotating speeds V2 and V1 for the time T2, and entering the next step;

(8) opening the drainage valve, controlling the inner tub to rotate at the rotating speed V4 until K is larger than or equal to K4, and entering the step (4);

(9) judging whether K is larger than or equal to K2, if yes, entering the next step, and if not, carrying out drainage until K is larger than or equal to K2, and entering the next step;

(10) controlling the inner tub to rotate at a rotating speed V3 until K is larger than or equal to K3, and entering the step (7); and

(11) performing the dewatering program until the dewatering is ended.

The rotating speeds of the inner tub are controlled as above, i.e., V1>V2>V3>V4.

Further, an alternative solution of the solution is that a drainage and dewatering control method for a self-cleaning washing machine, provided by the present disclosure, comprises:

(1) carrying out drainage, opening the drainage valve, and entering the next step;

(2) judging whether the amount K of the cleaning particles per each unit volume of water in the space is larger than or equal to K5 or not, if yes, entering step (13), and if not, entering the next step;

(3) judging whether K is larger than or equal to K4 or not, if yes, entering the next step, and if not, entering step (6);

(4) closing the drainage valve, controlling the inner tub to rotate at the rotating speed V1 for the time T1, and entering the next step;

(5) opening the drainage valve, controlling the inner tub to rotate at the rotating speed V4 until K is larger than or equal to K5, and entering step (13);

(6) judging whether K is larger than or equal to K3 or not, if yes, entering the next step, and if not, entering step (9);

(7) judging whether the drainage and dewatering are the drainage and dewatering after washing or not, if yes, closing the drainage valve, controlling the inner tub to rotate at the rotating speed V2 for the time T3, and entering the next step, and if not, closing the drainage valve, and controlling the inner tub to respectively rotate at the rotating speeds V2 and V1 for the time T2, and entering the next step;

(8) opening the drainage valve, controlling the inner tub to rotate at the rotating speed V4 until K is larger than or equal to K4, and entering the step (4);

(9) judging whether K is larger than or equal to K2, if yes, entering the next step, and if not, entering step (11);

(10) controlling the inner tub to rotate at the rotating speed V3 until K is larger than or equal to K3, and entering the step (7);

(11) judging whether K is larger than or equal to K1 or not, if yes, entering the next step, and if not, carrying out drainage until K is larger than or equal to K1, and entering the next step;

(12) controlling the inner tub to rotate at the rotating speed V4 until K is larger than or equal to K2, and entering the step (10); and

(13) performing the dewatering program until the dewatering is ended.

The four specific drainage and dewatering control methods are set according to the capacity of the washing machine, the lower the capacity of the washing machine is, the fewer the control stages set in the drainage and dewatering processes are, i.e., the smaller the amount of the cleaning particles, which are prearranged in the washing machine and used for controlling the change of the rotating speed of the inner tub, per each unit volume of water in the space is.

Wherein K1<K2<K3<K4<K5, and V1>V2>V3>V4.

V1: 120-300 RPM, preferably 120-160 RPM,

V2: 50-300 RPM, preferably 80-120 RPM,

V3: 0-120 RPM, preferably 30-80 RPM,

V4: 0-50 RPM, preferably 0-30 RPM.

An inner tub rotating speed control stage corresponding to the amount K4 of the cleaning particles prearranged per each unit volume of water in the space of the washing machine is a state of cleaning the bottom walls of the inner tub and the outer tub, and the water level at the stage is located in a region at the height where the bottom of the inner tub is located. K5 is correspondingly an empty tub point determined by a water level sensor of the washing machine. When the concentration of the cleaning particles is relatively low, i.e., the amount of the water in the tub is large, only drainage is carried out, but the tub does not rotate or the tub rotates at a low speed, so that the additional consumption of power of a motor can be avoided.

Further, the amount of the cleaning particles per each unit volume of water in the space is calculated according to a detected water level after the total amount of the cleaning particles in the space of the washing machine is determined, wherein the amount K of the cleaning particles per each unit volume of water in the space is equal to $N/\Delta V$, N is the total amount of the cleaning particles in the space located between the inner tub and the outer tub, $\Delta V$ is the volume of the water in the space located between the inner tub and the outer tub and is equal to $\alpha L$, $\alpha$ is a fixed coefficient, and L is the water level.

In an initial state of the washing machine, the amount of the placed cleaning parts is required to be input to the washing machine; and after the washing machine is used for a relatively long time, the cleaning particles can be worn or relatively seriously polluted and are required to be replaced with new cleaning particles, and the amount of the cleaning particles is also required to be input after the cleaning particles are replaced.

Further, in the dewatering program, the rotating speed of the inner tub is subjected to a staged acceleration process, which can be a constant rotating speed in respective stages, or can be continuously and gradually increased in respective stages, or can be uniformly increased in the whole dewatering process. Preferably, the inner tub is controlled to rotate at a constant speed in each stage so as to dewater, and therefore, the phenomenon that noise is generated by collision with the walls of the tubs due to the re-pumping of the cleaning particles from a drainage device at the lower part to a position between the inner tub and the outer tub by a centrifugal force generated by the continuous accelerated movement of the inner tub is avoided.

After the technical solution is adopted, compared with the prior art, the drainage and dewatering control method has the following beneficial effects.

The self-cleaning washing machine provided by the present disclosure is a washing machine provided with the cleaning particles between the inner tub and the outer tub so as to have a function of cleaning the walls of the inner tub and the outer tub, the water between the inner tub and the outer tub is exchanged with the water in the inner tub in the washing process of the washing machine to form the water flow which drives the cleaning particles between the inner tub and the outer tub to move in the water to generate collision and friction with the walls of the inner tub and the outer tub, so that attachments on the walls of the inner tub and the outer tub are cleared, the dirt is avoided, and the bacteria breeding is prevented.

The cleaning particles of the washing machine provided by the present disclosure not only can be used for cleaning the walls of the inner tub and the outer tub in the washing process, but also can be used for cleaning the walls of the inner tub and the outer tub when carrying out drainage every time. The different rotating ways of the inner tub are adopted according to the concentration of the cleaning particles between the inner tub and the outer tub, and the strength and frequency of collision between the cleaning particles and the bottom walls of the tubs are regulated, so that the cleaning rate is increased. By using the control method for changing drainage, the outer side of the inner tub and the inner side and bottom of the outer tub of the washing machine are cleaned, residual dirt is removed, and an inner environment for cleaning the clothes is kept clean.

During the drainage of the washing machine of the present disclosure, the washing machine regulates the movement way of the inner tub in the drainage process according to the determined amount of the cleaning particles per each unit volume of water in the space so as to improve the strength and frequency of friction and collision between the cleaning particles and the walls of the tubs, the larger the amount of the cleaning particles per each unit volume of water in the space is, the higher the rotating speed of the inner tub is controlled to be. Particularly, when drainage is carried out to a certain stage and the bottom wall of the inner tub is cleaned, the cleaning particles are centralized in a region near the bottom of the inner tub, the concentration of the cleaning particles, namely the amount of the cleaning particles per each unit volume of water is the largest, the rotating speed of the inner tub at the drainage stage is the highest, and the strength and frequency of collision between the cleaning particles and the bottom walls of the tubs reach the maximum extent, so that the bottom walls of the tubs are better cleaned. Therefore, the all-dimensional cleaning of the walls of the inner tub and the outer tub is realized, the cleanliness of the tubs is increased, and the cleaning rate is effectively increased. The inner tub and the outer tub is also cleaned by the cleaning particles while carrying out drainage, so that no dirt is retained, and the washing machine is clean and reassuring.

During dewatering after washing, washing water contains more foam, and therefore, foam overflowing and motor restricted rotation are easily caused if the tub rotates at a high speed; and in the drainage process, the concentration of the cleaning particles and whether the drainage and dewatering are drainage and dewatering after washing or not are comprehensively judged, and the rotating speed of the inner tub is reasonably controlled, so that problems caused by foam overflowing are avoided, and the safety coefficient is increased.

By controlling the inner tub to rotate at a staged variable speed during drainage, the walls of the inner tub and the outer tub can be efficiently cleaned, and meanwhile, the collection of the cleaning particles can be assisted, particularly, drainage stay, namely the operation of rotating the tub at a high speed while the drainage valve is closed, is set at the whole drainage stage. Thus, the cleaning particles strike the walls of the tubs at a high speed along with the water flow, and the process is similar to a process that an oil tub is cleaned by shaking sand grains and water in daily life, so that an unexpected cleaning effect is achieved.

When the concentration of the cleaning particles is relatively high, drainage is stopped, and the inner tub is controlled to rotate. Found by tests, the efficiency of cleaning the walls of the tubs by the cleaning particles can be reduced if drainage is carried out while the inner tub is controlled to rotate when the concentration of the cleaning particles is relatively high, it is because the cleaning particles can be affected by drainage due to the small amount of water in the tubs during drainage, and the frequency and strength of friction and collision between the cleaning particles and the walls of the tubs are reduced; and when the concentration of the cleaning particles is relatively low, even if drainage is carried out, the cleaning of the walls of the tubs is not affected because the floating range of the cleaning particles in the water is relatively wide due to the relatively large amount of the water, and influences from drainage at the bottom are also fewer. And therefore, the closing stage of the drainage valve is set and the rotating speed of the inner tub is controlled in the drainage process according to the concentration of the cleaning particles in the tubs.

DETAILED DESCRIPTION

The detailed description of the present disclosure is further described in detail below in combination with the accompanying drawings.

Figure 1:
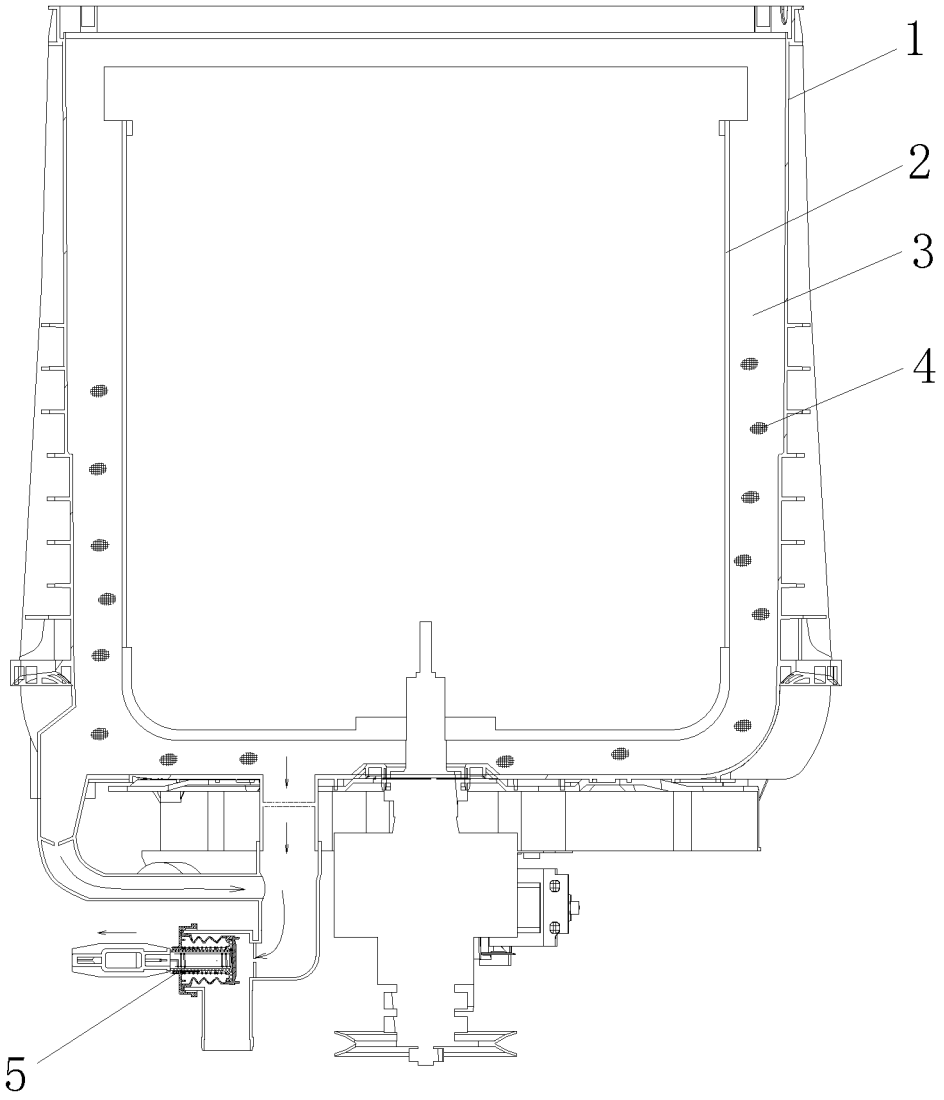
FIG. 1 is a structural schematic diagram of a self-cleaning washing machine provided by the present disclosure.

As shown in FIG. 1, a self-cleaning washing machine provided by the present disclosure comprises an outer tub 1 and an inner tub 2, cleaning particles 4 for cleaning the walls of the tubs are arranged inside a space 3 located between the inner wall of the outer tub 1 and the outer wall of the inner tub 2, the bottom of the outer tub 1 is provided with a drainage valve 5 capable of collecting the cleaning particles, the cleaning particles drop down along with a water level and are finally discharged into the drainage valve 5 so as to be collected during drainage, and the cleaning particles rise along with the water level and enter the space 3 after water is fed next time.

In the drainage and dewatering processes of the washing machine provided by the present disclosure, the concentration of the cleaning particles in the space located between the inner tub and the outer tub is changed, i.e., the amount of the cleaning particles per each unit volume of water in the space is changed along with the reduction of the water level. The corresponding relationship between the changing of the concentration of the cleaning particles and rotating speed of the inner tub is stored in the washing machine, the washing machine receives a drainage instruction and opens the drainage valve; the amount of the cleaning particles per each unit volume of water in the space is judged; and the washing machine correspondingly controls the rotating speed of the inner tub according to the concentration and regulates the frequency of friction and collision between the cleaning particles and the inner and outer tub walls.

Because the amount of the cleaning particles placed in the space located between the inner tub and the outer tub of the washing machine is fixed in an initial state of the washing machine, the cleaning particles will be worn or relatively seriously polluted and need to be replaced with new cleaning particles after the washing machine is used for a relatively long time. Therefore, the amount of the cleaning particles per each unit volume of water in the space is related to the water level after the cleaning particles are replaced, the amount of the cleaning particles per each unit volume of water in the space is calculated according to the detected water level, the amount K of the cleaning particles per each unit volume of water in the space is equal to $N/\Delta V$, N is the total amount of the cleaning particles in the space located between the inner tub and the outer tub, $\Delta V$ is the volume of the water in the space located between the inner tub and the outer tub and is equal to $\alpha L$, $\alpha$ is a fixed coefficient, and L is the water level.

However, the amount of the cleaning particles can be increased or reduced according to the demand of the user after the cleaning particles are replaced, at the moment, the amount of the cleaning particles is not fixed any more, the washing machine needs to determine the amount of the cleaning particles again, the water level corresponding to the same concentration is also changed before and after the cleaning particles in the space are replaced in the drainage and dewatering processes. While the cleanliness of the walls of the inner tub and the outer tub is not only related to the set rotating speed of the inner tub, but also related to the concentration of the cleaning particles under the water level in the drainage process. Therefore, the rotating speed of the inner tub is controlled according to the change of the concentration of the cleaning particles, and the rotating speed of the inner tub is combined with the concentration of the cleaning particles, so that the cleaning of the cleaning particles to the walls of the inner tub and the outer tub is controlled.

Specifically, the washing machine divides the drainage and dewatering processes into at least two control stages according to the amount of the cleaning particles per each unit volume of water in the space, different rotating ways of the inner tub are set in respective stages, and the rotating speed of the inner tub is higher in the stage that the amount of the cleaning particles per each unit volume of water is larger. The washing machine selects the corresponding control stage in the drainage and dewatering processes according to the detected amount of the cleaning particles per each unit volume of water in the space and controls the inner tub to rotate in a preset rotating way of the inner tub at the stage.

The lower the capacity of the washing machine is, the narrower the change range of the concentration of the cleaning particles in the space during drainage is, and the fewer the control stages set in the drainage and dewatering processes of the washing machine are. 2-5 control stages are set according to the capacity of the existing washing machine, it is because the lower the capacity is, the smaller the amount of water at the maximum water level is, and the drainage speed is very high, so that the service life of the motor is shorted if the rotating speed of the inner tub is frequently changed within short time in the drainage process; and next, the smaller the capacity of the washing machine is, the lower the possibility that the dirt is formed on the walls of the tubs is, and the cleaning particles can basically clean the walls of the tubs in the washing process. However, the setting way is not necessary, and the number of the set stages can also be reduced when relatively little dirt is attached to the walls of the tubs due to the materials of the inner tub and the outer tub of the washing machine or other reasons.

A control method for controlling the rotation of the inner tub at one control stage in the drainage and dewatering processes comprises: closing the drainage valve, controlling the inner tub to rotate at a set rotating speed for a set time, then opening the drainage valve, controlling the inner tub to rotate at the other set rotating speed and determining the amount of the cleaning particles per each unit volume of water, and entering the next control stage when the amount of the cleaning particles per each unit volume of water conforms to the amount corresponding to the next stage.

A control stage for the cleaning of the bottom walls of the inner tub and the outer tub is also arranged to correspond to the concentration of the cleaning particles, and the water level corresponding to the stage is located in the region at the height where the bottom of the inner tub is located.

Whether the current steps of drainage and dewatering are steps of drainage and dewatering after washing or not is judged when the amount of the cleaning particles per each unit volume of water in the space is determined to meet a set condition, if the drainage and dewatering are the drainage and dewatering after washing, the drainage valve is closed firstly, the inner tub is controlled to rotate at a set rotating speed for a set time, then, the drainage valve is opened, the inner tub is controlled to rotate at the other set rotating speed; and if the drainage and dewatering are not the drainage and dewatering after washing, the drainage valve is closed firstly, the inner tub is controlled to respectively rotate with at least two different rotating speeds for a set time, then, the drainage valve is opened, and the inner tub is controlled to rotate at another set rotating speed. The rotating speed of the inner tub when the drainage valve is closed is controlled to be higher than the rotating speed of the inner tub when the drainage valve is opened.

The drainage and dewatering processes of the drainage and dewatering control method include a control stage corresponding to a dewatering program in which the rotating speed of the inner tub is subjected to a staged acceleration process, can be a constant rotating speed in respective stages, or can be continuously and gradually increased in respective stages, or can be uniformly increased in the whole dewatering process, preferably, the inner tub is controlled to rotate in a staged constant way so as to dewater, and therefore, the phenomenon that noise is generated by collision with the walls of the tubs due to the re-pumping of the cleaning particles from a drainage device at the lower part to a position between the inner tub and the outer tub by a centrifugal force generated by the continuous accelerated movement of the inner tub is avoided.

Embodiment 1

Figure 2:
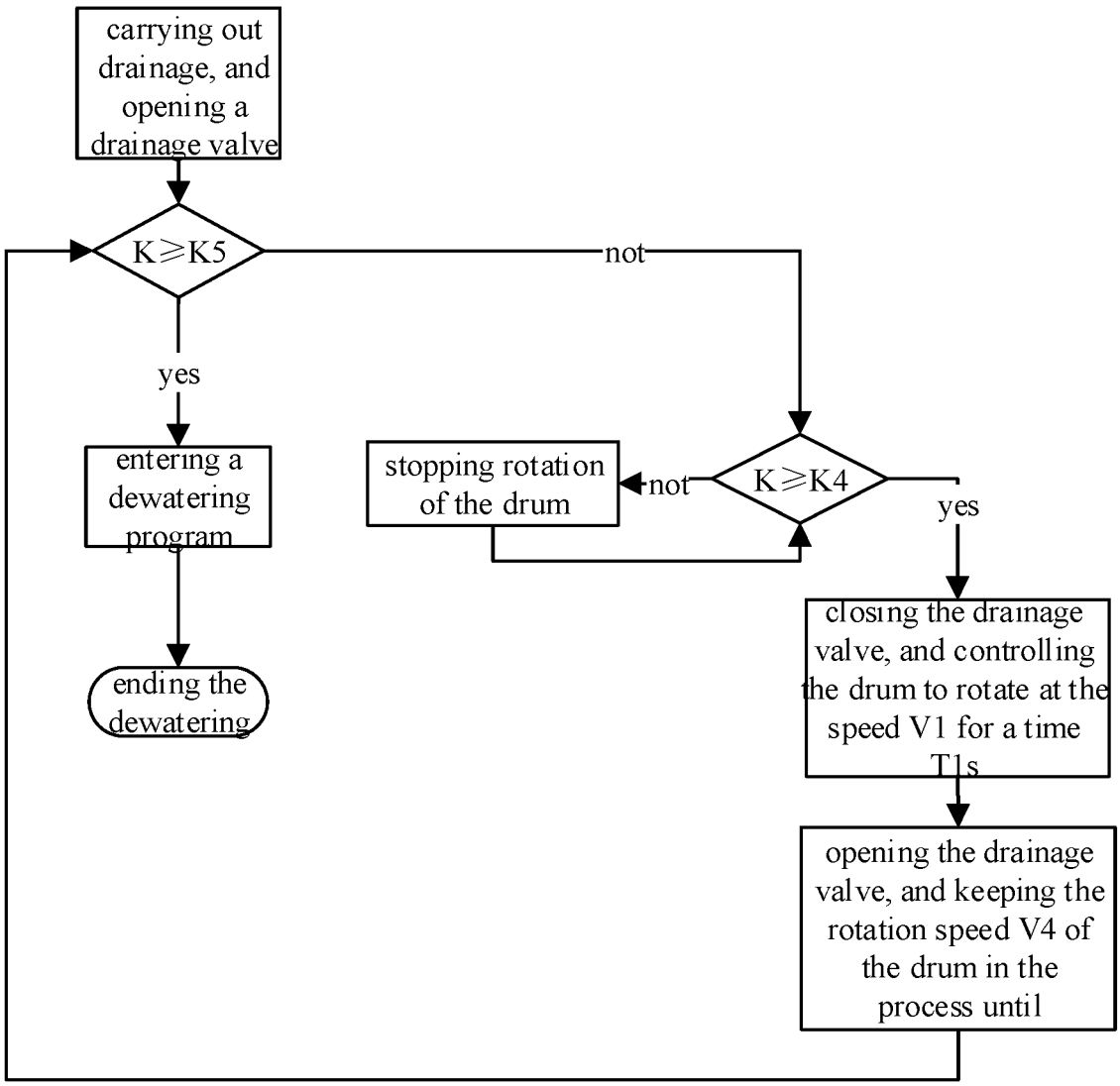
FIG. 2 is a flow diagram of a drainage and dewatering control method in an embodiment 1 of the present disclosure.

As shown in FIG. 2, the drainage and dewatering control method for the self-cleaning washing machine in the embodiment comprises:

(1) carrying out drainage, opening the drainage valve, and entering the next step;

(2) judging whether the amount K of the cleaning particles per each unit volume of water in the space is larger than or equal to K5 or not, if yes, entering step (6), and if not, entering the next step;

(3) judging whether K is larger than or equal to K4 or not and whether K4 is smaller than K5 or not, if yes, entering the next step, and if not, carrying out drainage until K is larger than or equal to K4, and entering the next step;

(4) closing the drainage valve, controlling the inner tub to rotate at a rotating speed V1 (which is equal to 200 RPM) for 2 S, and entering the next step;

(5) opening the drainage valve, controlling the inner tub to rotate at a rotating speed V4 (which is equal to 20 RPM) until K is larger than or equal to K5, and entering the next step; and (6) performing a dewatering program until the dewatering is ended.

K5 is correspondingly an empty tub point determined by a water level sensor of the washing machine, and the washing machine immediately enters the dewatering program once the concentration of the cleaning particles is determined to reach K5. When the concentration of the cleaning particles is relatively low, i.e., the amount of the water in the tub is large, only drainage is carried out, but the tub does not rotate or the tub rotates at a low speed, so that the additional consumption of power of a motor can be avoided.

Embodiment 2

Figure 3:
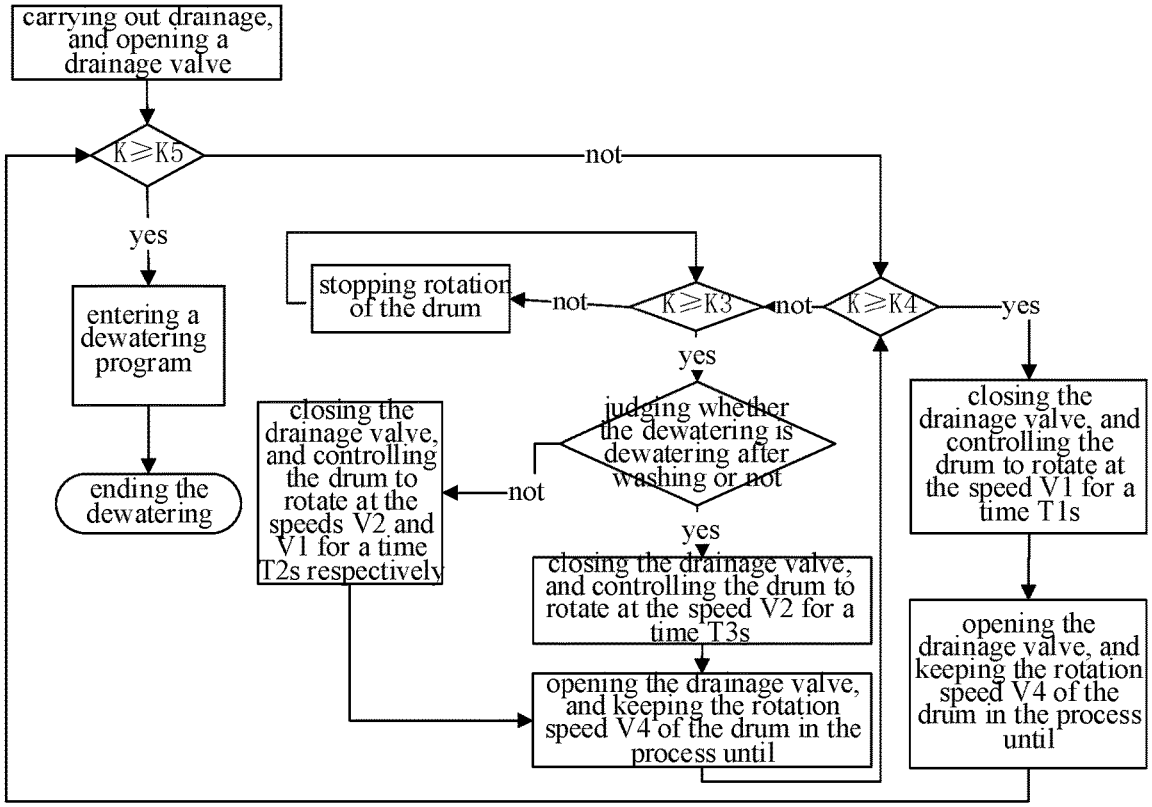
FIG. 3 is a flow diagram of the drainage and dewatering control method in an embodiment 2 of the present disclosure.

As shown in FIG. 3, the drainage and dewatering control method for the self-cleaning washing machine in the embodiment comprises:

(1) carrying out drainage, opening the drainage valve, and entering the next step;

(2) judging whether the amount K of the cleaning particles per each unit volume of water in the space is larger than or equal to K5 or not, if yes, entering step (9), and if not, entering the next step;

(3) judging whether K is larger than or equal to K4 or not, if yes, entering the next step, and if not, entering step (6);

(4) closing the drainage valve, controlling the inner tub to rotate at the rotating speed V1 (which is equal to 160 RPM) for 3 S, and entering the next step;

(5) opening the drainage valve, controlling the inner tub to rotate at the rotating speed V4 (which is equal to 30 RPM) until K is larger than or equal to K5, and entering step (9);

(6) judging whether K is larger than or equal to K3 or not, if yes, entering the next step, and if not, carrying out drainage until K is larger than or equal to K3, and entering the next step;

(7) judging whether the drainage and dewatering are the drainage and dewatering after washing or not, if yes, closing the drainage valve, controlling the inner tub to rotate at a rotating speed V2 (which is equal to 100 RPM) for 4 S, and entering the next step, and if not, closing the drainage valve, and controlling the inner tub to respectively rotate at the rotating speeds V2 (which is equal to 100 RPM) and V1 (which is equal to 160 RPM) for 2 S, and entering the next step;

(8) opening the drainage valve, controlling the inner tub to rotate at the rotating speed V4 (which is equal to 30 RPM) until K is larger than or equal to K4, and entering the step (4); and (9) performing the dewatering program until the dewatering is ended.

Embodiment 3

Figure 4:
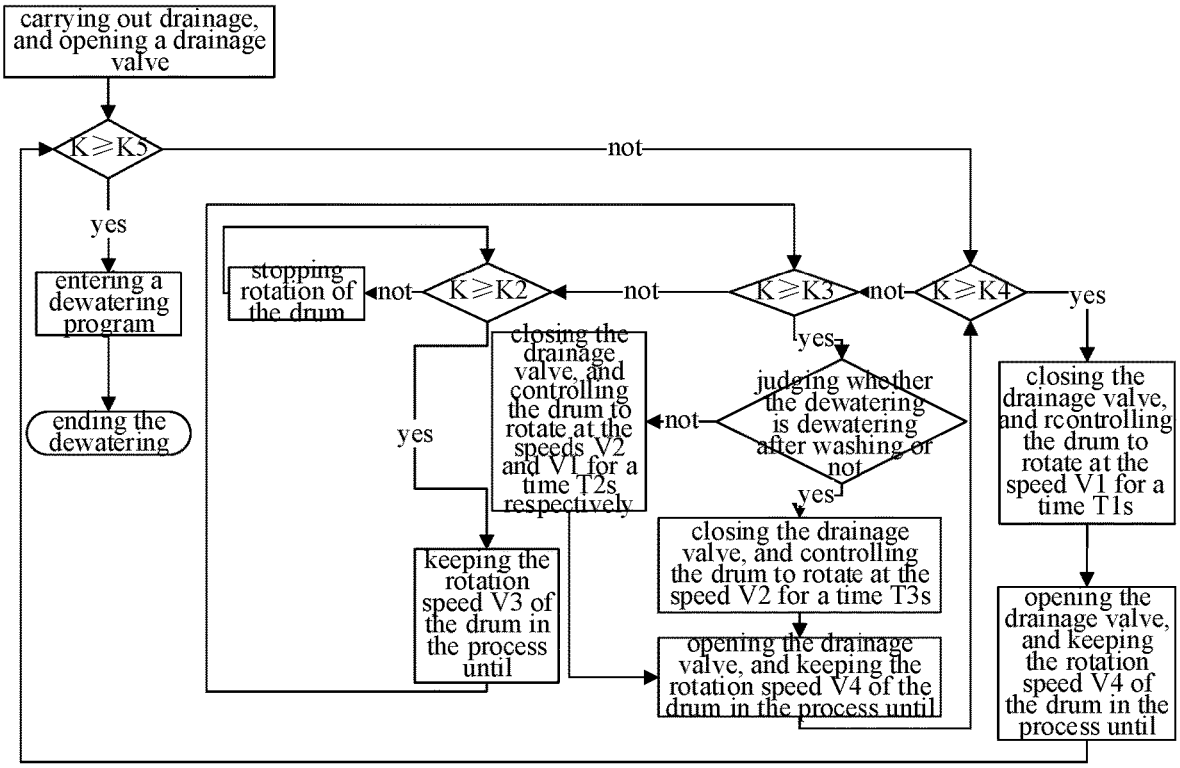
FIG. 4 is a flow diagram of the drainage and dewatering control method in an embodiment 3 of the present disclosure.

As shown in FIG. 4, the drainage and dewatering control method for the self-cleaning washing machine in the embodiment comprises:

(1) carrying out drainage, opening the drainage valve, and entering the next step;

(2) judging whether the amount K of the cleaning particles per each unit volume of water in the space is larger than or equal to K5 or not, if yes, entering step (11), and if not, entering the next step;

(3) judging whether K is larger than or equal to K4 or not, if yes, entering the next step, and if not, entering step (6);

(4) closing the drainage valve, controlling the inner tub to rotate at the rotating speed V1 (which is equal to 150 RPM) for 2 S, and entering the next step;

(5) opening the drainage valve, controlling the inner tub to rotate at the rotating speed V4 (which is equal to 20 RPM) until K is larger than or equal to K5, and entering step (11);

(6) judging whether K is larger than or equal to K3 or not, if yes, entering the next step, and if not, entering step (9);

(7) judging whether the drainage and dewatering are the drainage and dewatering after washing or not, if yes, closing the drainage valve, controlling the inner tub to rotate at the rotating speed V2 (which is equal to 80 RPM) for 5 S, and entering the next step, and if not, closing the drainage valve, and controlling the inner tub to respectively rotate at the rotating speeds V2 (which is equal to 80 RPM) and V1 (which is equal to 150 RPM) for 3 S, and entering the next step;

(8) opening the drainage valve, controlling the inner tub to rotate at the rotating speed V4 (which is equal to 20 RPM) until K is larger than or equal to K4, and entering the step (4);

(9) judging whether K is larger than or equal to K2, if yes, entering the next step, and if not, carrying out drainage until K is larger than or equal to K2, and entering the next step;

(10) controlling the inner tub to rotate at a rotating speed V3 (which is equal to 50 RPM) until K is larger than or equal to K3, and entering the step (7); and

(11) performing the dewatering program until the dewatering is ended.

Embodiment 4

Figure 5:
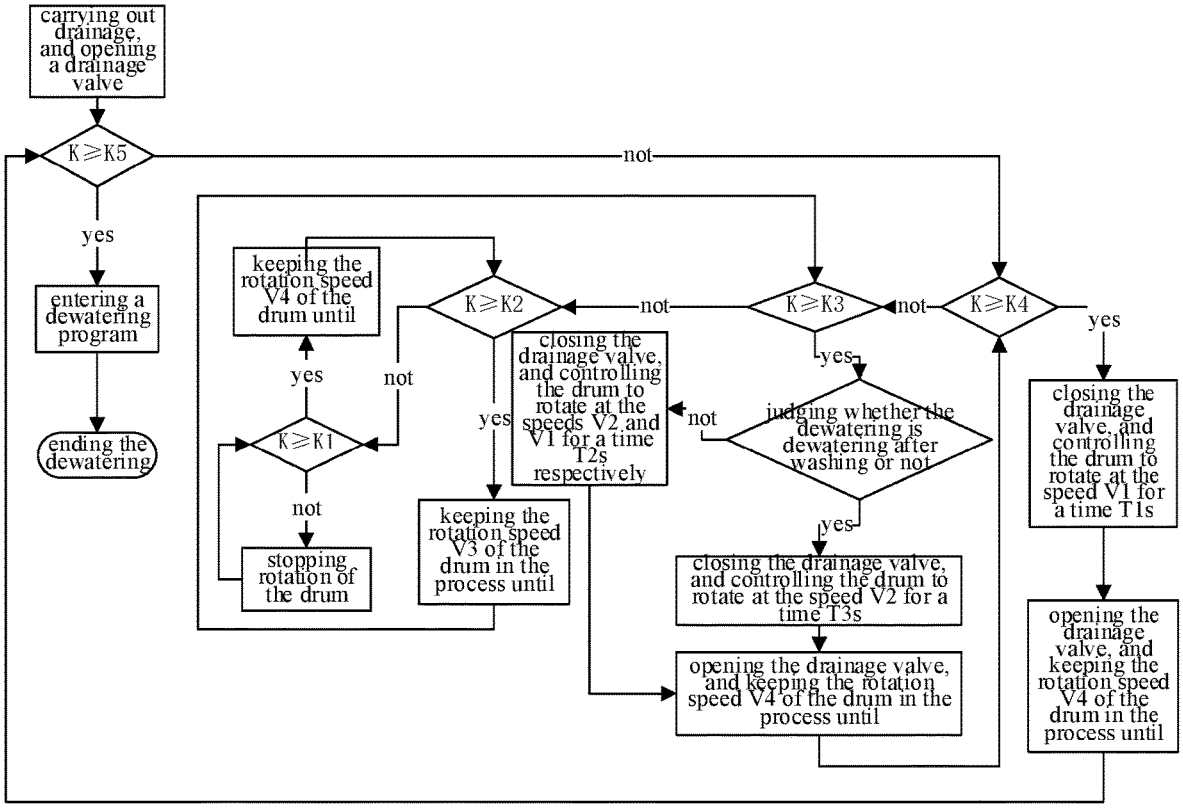
FIG. 5 is a flow diagram of the drainage and dewatering control method in an embodiment 4 of the present disclosure.

As shown in FIG. 5, the drainage and dewatering control method for the self-cleaning washing machine in the embodiment comprises:

(1) carrying out drainage, opening the drainage valve, and entering the next step;

(2) judging whether the amount K of the cleaning particles per each unit volume of water in the space is larger than or equal to K5 or not, if yes, entering step (13), and if not, entering the next step;

(3) judging whether K is larger than or equal to K4 or not, if yes, entering the next step, and if not, entering step (6);

(4) closing the drainage valve, controlling the inner tub to rotate at the rotating speed V1 (which is equal to 120 RPM) for 3 S, and entering the next step;

(5) opening the drainage valve, controlling the inner tub to rotate at the rotating speed V4 (which is equal to 10 RPM) until K is larger than or equal to K5, and entering step (13);

(6) judging whether K is larger than or equal to K3 or not, if yes, entering the next step, and if not, entering step (9);

(7) judging whether the drainage and dewatering are the drainage and dewatering after washing or not, if yes, closing the drainage valve, controlling the inner tub to rotate at the rotating speed V2 (which is equal to 60 RPM) for 6 S, and entering the next step, and if not, closing the drainage valve, and controlling the inner tub to respectively rotate at the rotating speeds V2 (which is equal to 60 RPM) and V1 (which is equal to 120 RPM) for 3 S, and entering the next step;

(8) opening the drainage valve, controlling the inner tub to rotate at the rotating speed V4 (which is equal to 10 RPM) until K is larger than or equal to K4, and entering the step (4);

(9) judging whether K is larger than or equal to K2, if yes, entering the next step, and if not, entering step (11);

(10) controlling the inner tub to rotate at the rotating speed V3 (which is equal to 50 RPM) until K is larger than or equal to K3, and entering the step (7);

(11) judging whether K is larger than or equal to K1 or not, if yes, entering the next step, and if not, carrying out drainage until K is larger than or equal to K1, and entering the next step;

(12) controlling the inner tub to rotate at the rotating speed V4 (which is equal to 10 RPM) until K is larger than or equal to K2, and entering the step (10); and

(13) performing the dewatering program until the dewatering is ended.

In the embodiment, K1<K2<K3<K4<K5, and V1>V2>V3>V4.

V1: 120-300 RPM, preferably 120-160 RPM,

V2: 50-300 RPM, preferably 80-120 RPM,

V3: 0-120 RPM, preferably 30-80 RPM,

V4: 0-50 RPM, preferably 0-30 RPM.

The implementation solutions in the above embodiments are merely intended to describe preferable embodiments of the present disclosure, each rotating parameter of the inner tub in the above embodiments is not intended to limit the conception and scope of the present disclosure, and various variations and modifications made on the technical solutions of the present disclosure by those skilled in the art fall into the protective scope of the present disclosure without departing from design concepts of the present disclosure.

The invention claimed is:

1. A drainage and dewatering control method for a self-cleaning washing machine, the washing machine including an inner tub and an outer tub and cleaning particles for cleaning an outer wall of the inner tub and an inner wall of the outer tub along with movement of a water flow, the cleaning particles arranged in a space located between the inner tub and the outer tub of the washing machine, the method comprising:

receiving a drainage instruction, and opening a drainage valve;

determining an amount of the cleaning particles per each unit volume of water in the space;

controlling a rotating speed of the inner tub;

regulating a frequency of friction and collision between the cleaning particles and the inner and outer tub walls;

dividing drainage and dewatering processes of the washing machine into at least two control stages according to the amount of the cleaning particles per each unit volume of water in the space; and setting different rotating speeds of the inner tub in respective control stages of the at least two control stages, where a rotating speed of the inner tub is higher in the respective control stages than other respective control stages wherein the amount of the cleaning particles per each unit volume of water is larger.

2. The drainage and dewatering control method for the self-cleaning washing machine according to claim 1, wherein the washing machine selects correspondingly the control stage in the drainage and dewatering processes according to the determined amount of the cleaning particles per each unit volume of water in the space.

3. The drainage and dewatering control method for the self-cleaning washing machine according to claim 1, wherein a method for controlling a rotation of the inner tub in one control stage comprises:

closing the drainage valve, controlling the inner tub to rotate at a set rotating speed for a set time, then opening the drainage valve, controlling the inner tub to rotate at another set rotating speed and determining the amount of the cleaning particles per each unit volume of water, and entering a next control stage when the amount of the cleaning particles per each unit volume of water conforms to an amount corresponding to the next control stage.

4. The drainage and dewatering control method for the self-cleaning washing machine according to claim 1 comprising:

determining whether the current steps of drainage and dewatering are steps of drainage and dewatering after washing or not, when determining that the amount of the cleaning particles per each unit volume of water in the space meets a set condition, and regulating the different rotating speeds of the inner tub according to the determination whether the washing machine is performing drainage and dewatering after washing or not.

5. The drainage and dewatering control method for the self-cleaning washing machine according to claim 4 comprising:

determining that the current drainage and dewatering are the steps of drainage and dewatering after washing, closing the drainage valve, controlling the inner tub to rotate at a set rotating speed for a set time, opening the drainage valve, and controlling the inner tub to rotate at another set rotating speed; or determining that the drainage and dewatering are not the steps of drainage and dewatering after washing, closing the drainage valve, controlling the inner tub to respectively rotate with at least two different rotating speeds for a set time, opening the drainage valve, and controlling the inner tub to rotate at another set rotating speed.

6. The drainage and dewatering control method for the self-cleaning washing machine according to claim 3 comprising: controlling a rotating speed of the inner tub when the drainage valve is closed to be higher than a rotating speed of the inner tub when the drainage valve is opened.

7. The drainage and dewatering control method for the self-cleaning washing machine according to claim 1 comprising:

(1) carrying out drainage, opening the drainage valve, and entering next step;

(2) judging whether an amount K of the cleaning particles per each unit volume of water in the space is larger than or equal to K5 or not, if yes, entering step (6), and if not, entering next step;

(3) judging whether K is larger than or equal to K4 or not, if yes, entering the next step, and if not, carrying out drainage until K is larger than or equal to K4, and entering next step;

(4) closing the drainage valve, controlling the inner tub to rotate at a rotating speed V1 for a time T1, and entering next step;

(5) opening the drainage valve, controlling the inner tub to rotate at a rotating speed V4 until K is larger than or equal to K5, and entering next step; and (6) performing a dewatering program until the dewatering is ended.

8. The drainage and dewatering control method for the self-cleaning washing machine according to claim 1 comprising:

(1) carrying out drainage, opening the drainage valve, and entering next step;

(2) judging whether an amount K of the cleaning particles per each unit volume of water in the space is larger than or equal to K5 or not, if yes, entering step (9), and if not, entering next step;

(3) judging whether K is larger than or equal to K4 or not, if yes, entering next step, and if not, entering step (6);

(4) closing the drainage valve, controlling the inner tub to rotate at a rotating speed V1 for a time T1, and entering next step;

(5) opening the drainage valve, controlling the inner tub to rotate at a rotating speed V4 until K is larger than or equal to K5, and entering the step (9);

(6) judging whether K is larger than or equal to K3 or not, if yes, entering next step, and if not, carrying out drainage until K is larger than or equal to K3, and entering next step;

(7) judging whether the drainage and dewatering are the steps of drainage and dewatering after washing or not, if yes, closing the drainage valve, controlling the inner tub to rotate at a rotating speed V2 for a time T3, and entering next step, and if not, closing the drainage valve, and controlling the inner tub to respectively rotate at the rotating speeds V2 for a time T2 and V1 for a time T2, and entering next step;

(8) opening the drainage valve, controlling the inner tub to rotate at a rotating speed V4 until K is larger than or equal to K4, and entering the step (4); and (9) performing a dewatering program until dewatering is ended.

9. The drainage and dewatering control method for the self-cleaning washing machine according to claim 1 comprising:

(1) carrying out drainage, opening the drainage valve, and entering next step;

(2) judging whether an amount K of the cleaning particles per each unit volume of water in the space is larger than or equal to K5 or not, if yes, entering step (11), and if not, entering next step;

(3) judging whether K is larger than or equal to K4 or not, if yes, entering next step, and if not, entering step (6);

(4) closing the drainage valve, controlling the inner tub to rotate at a rotating speed V1 for a time T1, and entering next step;

(5) opening the drainage valve, controlling the inner tub to rotate at a rotating speed V4 until K is larger than or equal to K5, and entering the step (11);

(6) judging whether K is larger than or equal to K3 or not, if yes, entering next step, and if not, entering step (9);

(7) judging whether the drainage and dewatering are the steps of drainage and dewatering after washing or not, if yes, closing the drainage valve, controlling the inner tub to rotate at a rotating speed V2 for a time T3, and entering next step, and if not, closing the drainage valve, and controlling the inner tub to respectively rotate at the rotating speeds V2 for a time T2 and V1 for a time T2, and entering next step;

(8) opening the drainage valve, controlling the inner tub to rotate at a rotating speed V4 until K is larger than or equal to K4, and entering the step (4);

(9) judging whether K is larger than or equal to K2, if yes, entering next step, and if not, carrying out drainage until K is larger than or equal to K2, and entering next step;

(10) controlling the inner tub to rotate at a rotating speed V3 until K is larger than or equal to K3, and entering the step (7); and

(11) performing a dewatering program until dewatering is ended.

10. The drainage and dewatering control method for the self-cleaning washing machine according to claim 1 comprising:

(1) carrying out drainage, opening the drainage valve, and entering next step;

(2) judging whether an amount K of the cleaning particles per each unit volume of water in the space is larger than or equal to K5 or not, if yes, entering step (13), and if not, entering next step;

(3) judging whether K is larger than or equal to K4 or not, if yes, entering next step, and if not, entering step (6);

(4) closing the drainage valve, controlling the inner tub to rotate at a rotating speed V1 for a time T1, and entering next step;

(5) opening the drainage valve, controlling the inner tub to rotate at a rotating speed V4 until K is larger than or equal to K5, and entering step (13);

(6) judging whether K is larger than or equal to K3 or not, if yes, entering next step, and if not, entering step (9);

(7) judging whether the drainage and dewatering are the steps of drainage and dewatering after washing or not, if yes, closing the drainage valve, controlling the inner tub to rotate at a rotating speed V2 for a time T3, and entering the next step, and if not, closing the drainage valve, and controlling the inner tub to respectively rotate at the rotating speeds V2 for a time T2 and V1 for a time T2, and entering next step;

(8) opening the drainage valve, controlling the inner tub to rotate at a rotating speed V4 until K is larger than or equal to K4, and entering the step (4);

(9) judging whether K is larger than or equal to K2, if yes, entering next step, and if not, entering step (11);

(10) controlling the inner tub to rotate at a rotating speed V3 until K is larger than or equal to K3, and entering the step (7);

(11) judging whether K is larger than or equal to K1 or not, if yes, entering next step, and if not, carrying out drainage until K is larger than or equal to K1, and entering next step;

(12) controlling the inner tub to rotate at a rotating speed V4 until K is larger than or equal to K2, and entering the step (10); and

(13) performing a dewatering program until dewatering is ended.

11. The drainage and dewatering control method for the self-cleaning washing machine according to claim 1 comprising:

calculating the amount of the cleaning particles per each unit volume of water in the space according to a detected water level after determining a total amount of the cleaning particles in the space of the washing machine, wherein the amount K of the cleaning particles per each unit volume of water in the space is equal to $N/\Delta V$, N is the total amount of the cleaning particles in the space located between the inner tub and the outer tub, $\Delta V$ is a volume of water in the space located between the inner tub and the outer tub and is equal to $\alpha L$, $\alpha$ is a fixed coefficient, and L is the water level.

12. The drainage and dewatering control method for the self-cleaning washing machine according to claim 5 comprising: controlling a rotating speed of the inner tub when the drainage valve is closed to be higher than a rotating speed of the inner tub when the drainage valve is opened.

* * * * *